US005699740A

United States Patent [19]

Gelbart

[11] Patent Number: 5,699,740

[45] Date of Patent: Dec. 23, 1997

[54] METHOD OF LOADING METAL PRINTING PLATES ON A VACUUM DRUM

[75] Inventor: Daniel Gelbart, Vancouver, Canada

[73] Assignee: Creo Products Inc., Burnaby, Canada

[21] Appl. No.: 664,480

[22] Filed: Jun. 17, 1996

[51] Int. Cl.[6] ..... B41L 47/14

[52] U.S. Cl. ..... 101/477; 101/389.1

[58] Field of Search ..... 101/389.1, 477; 72/133, 169

[56] References Cited

U.S. PATENT DOCUMENTS

| | | | |
|---|---|---|---|
| 2,503,597 | 4/1950 | Rodder | 72/169 |
| 3,304,757 | 2/1967 | Achler et al. | 72/166 |
| 3,371,513 | 3/1968 | Achler et al. | 72/166 |
| 3,937,052 | 2/1976 | Hoexter et al. | 72/166 |
| 5,402,721 | 4/1995 | Schultz | 101/389.1 |
| 5,488,906 | 2/1996 | Iron et al. | 101/477 |
| 5,557,960 | 9/1996 | Hoffmann et al. | 72/51 |

FOREIGN PATENT DOCUMENTS

| | | |
|---|---|---|
| 4239253 | 5/1994 | Germany . |
| 5-200970 | 8/1993 | Japan . |

*Primary Examiner*—Edgar S. Burr
*Assistant Examiner*—Daniel J. Colilla

[57] ABSTRACT

Metal printing plates can be loaded onto a drum and held in place by vacuum alone if flat plates are given a permanent curl by a set of four rollers. Same rollers cancel out the curl when plate is unloaded from drum. The invention is useful for Computer-to-Plate and Computer-to-Press systems.

22 Claims, 2 Drawing Sheets

METHOD OF LOADING METAL PRINTING PLATES ON A VACUUM DRUM

FIELD OF THE INVENTION

The invention relates to printing, and in particular, to the loading of metal lithographic printing plates onto a drum, or cylinder, where they are held in place by the force of vacuum. The invention can be used on Computer-to-Plate or Computer-to-Press systems, also known as On-Press Imaging.

BACKGROUND OF THE INVENTION

Traditional imagesetters used in the pre-press area of a printing operation use vacuum to hold films to a rotating drum while exposing them using a laser. In order to image directly on lithographic printing plates, both in Computer-to-Plate and Computer-to-Press systems, a method of holding metal plates to the outside surface of a rotating drum, or cylinder, is desired. Due to the higher stiffness and thickness of metal printing plate the force of the vacuum, limited to atmospheric pressure, is insufficient to hold a metal plate onto a drum, in particular a rotating drum. Prior art solutions involve clamps (both mechanical and magnetic) as well as using steel plates on magnetic drums. Since most lithographic printing plates are made of aluminum and are non-magnetic it is desired to have a system holding the plate without clamps and without relying on magnetic properties. The plate can be imaged on the drum (as done in Computer-to-Plate and Computer-to-Press), or pre-imaged and mounted later on the plate cylinder of a printing press. In the latter application, using vacuum instead of clamps allows nearly gapless plate mounting and simplified automatic loading of plates. The invention can also be used to load onto a press thin metal backed flexographic plates and other metal backed plates.

BRIEF DESCRIPTION OF THE INVENTION

The invention relies on the fact that the thin sheets of metal used as a substrate for printing plates can be given a permanent curl to fit the form of the drum. If the plates were to be pre-curled it would cause handling problems, particularly during plate development, as well as the curl will have to be opened up to wrap the plate around the plate cylinder or imaging drum. For soft aluminum plates they will not spring back to fit on the cylinder. On the other hand, if the plate is fed to the drum as a flat sheet and the curl is imparted to the plate as it is wrapping itself on the drum, the plate can be made to fit the drum and stay in place even without vacuum. This curl can be generated by three rollers located next to the plate cylinder. The addition of a fourth roller allows the straightening out of the plate when it is being unloaded. This is important in a Computer-to-Plate system, where the plate has to come out as a flat sheet for handling reasons. The rollers operate in an arrangement similar to sheet metal rolling devices. The radius of the curl imparted to the plate can be smaller than the radius of the cylinder, thus the plate will stay securely on the drum even in the event of failure of the vacuum system. For on-press imaging applications, it is advantageous to increase the friction of the cylinder surface by embedding diamond grit into it. The diamond grit forms micro-indentations preventing any plate slippage during printing. The invention can be used for any plate based on a metal substrate, even if the active layer in nonmetallic.

DESCRIPTION OF THE PREFERRED EMBODIMENT

Figure 1:
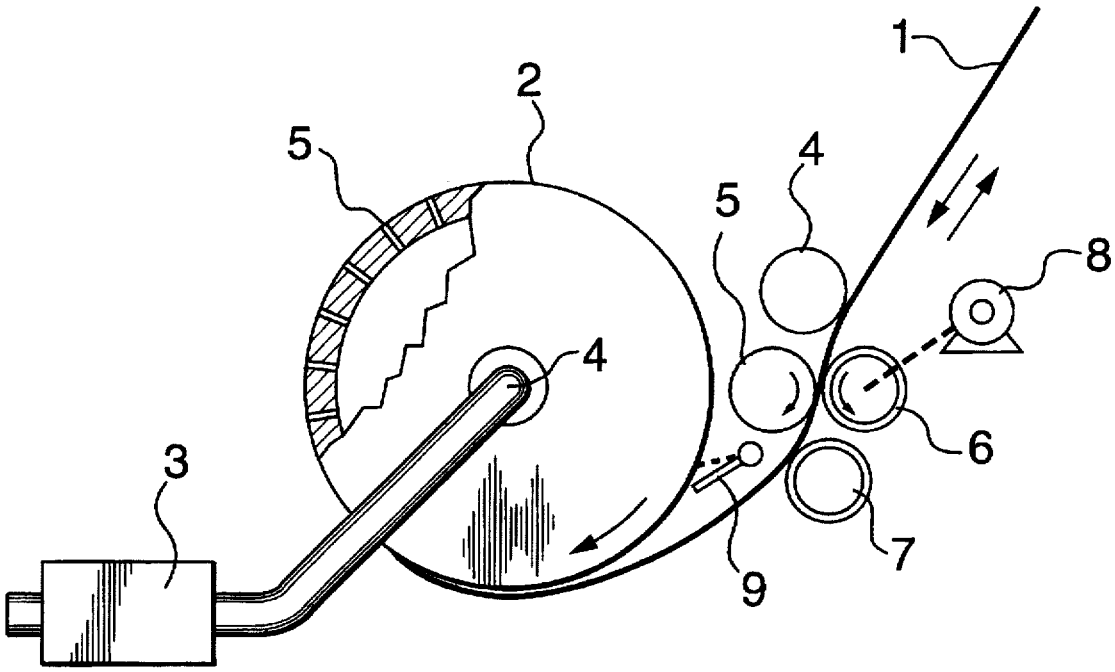
FIG. 1 shows schematically a side view of the invention.

Metal printing plate 1 is loaded on cylinder 2 and held in place by the action of vacuum. The inside of cylinder 2 is evacuated by vacuum pump 3, connected to the cylinder via a rotary vacuum fitting 4. The vacuum reaches the cylinder surface via small holes 5. This arrangement is common in film imagesetting devices and need not be detailed here. Cylinder 2 can, by way of example, be the imaging drum or cylinder of a Computer-to-Plate system. Once plate 1 is loaded on cylinder 2, cylinder 2 rotates and a laser (not shown) imagewise exposes the plate. Such Computer-to-Plate devices are commercially available and need no further details. Cylinder 2 can also be the plate cylinder of an offset lithographic sheet fed or web press. When cylinder 2 is part of a printing press it is desired to increase the friction between the plate cylinder and the plate, to avoid plate creep during the printing process. Such creep is detrimental in multi-color printing. In the preferred embodiment for on-press use, the friction between the surface of the plate cylinder and the plate is increased by embedding fine diamond powder (particle size from 50 to 100 microns) in the surface of the plate cylinder. The diamond powder (or any other hard and sharp particles) can be attached to the plate cylinder surface by rolling over them with a hard roller or by electroplating. For Computer-to-Plate applications no means to increase friction are required. Besides holes 5 other means can be used to bring and distribute the vacuum across the cylinder surface. Such means are well known in imagesetter design and need not be detailed here. For example, vacuum distribution means can be grooves, surface texture, porous cylinder wall and others.

A cluster of four rollers 4, 5, 6 and 7 is located in proximity to cylinder 2. It is sufficient to motorize one of the rollers 6 using motor 8. Motor 8 can be directly or indirectly coupled to roller 6. Since the outside surface of some printing plates can be sensitive to scratches, rollers 6 and 7 are coated with an elastomeric coating such as rubber or polyurethane. Rollers 5 and 6 form a pair of pinch rollers, with a gap comparable to the thickness of the plate. The exact gap is not critical and can exceed the plate thickness. All four rollers extend to the full length of cylinder 2. Roller 7 is located in the way of the plate emerging from rollers 5 and 6 and causes it to bend and curl towards cylinder 2. The position of roller 7 can be selected so that the residual curl imparted to plate 1 is about equal to the curvature of the cylinder 2 or the radius of the residual curl is smaller than the radius of cylinder 2. The advantage of the latter setting is that the plate "grips" the cylinder and will stay attached even if the vacuum is released while cylinder 2 is rotating.

Figure 2:
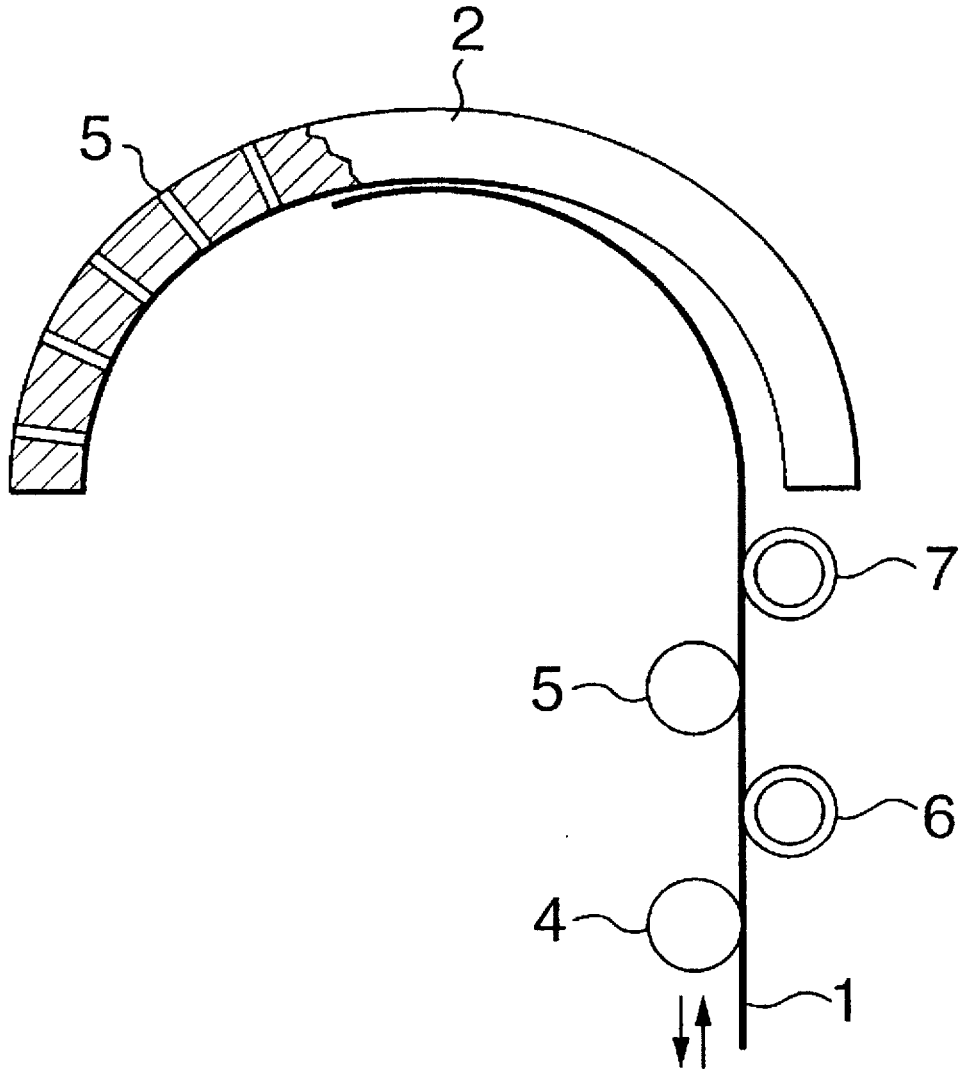
FIG. 2. shows a side view of an alternative embodiment of the invention.

To load a plate, plate 1 is inserted between rollers 5 and 6. Motorized roller 6 pulls the plate in, and it wraps itself around cylinder 2 which is rotated slowly to assist the loading. After loading vacuum pump 3 is activated to secure the plate. To unload the plate, drum 2 and roller 6 are rotated in the opposite direction. When plate edge is located ahead of diverter 9, diverter 9 is moved to touch drum 2, causing the plate to climb on diverter 9 and feed into pinch rollers 5 and 6. the vacuum is maintained on drum 2 during unloading to provide sufficient friction between drum 2 and plate 1 in order to push it over diverter 9 and into pinch rollers 5 and 6. Diverter 9 can be a solid sheet, extending the full length of drum 2, or a few "fingers" along drum 2. The details of the drum and diverter are similar to prior art used in drum imagesetters such as those made by Barco (Belgium) and Dainippon Screen (Japan) and are well known in the art. When plate 1 reaches roller 4 it will be bent in a direction opposite to the curl it acquired from roller 7. By placing roller 4 at the correct position the curl is cancelled out and the plate emerges flat, with the exception of a minor bend near the edge. By the way of example, if cylinder 2 is of a diameter of 250 mm the recommended diameters of rollers 4, 5, 6 and 7 is about 50 mm each. The arrangement shown will load aluminum printing plates from 0.1 mm to 0.3 mm in thickness onto the drum. The required vacuum can be as low as 150 mm Hg, however a higher vacuum of about 500 mm Hg is desired. While the preferred embodiment uses the curl of the plate to fit on the outside of a cylinder it is obvious that the same method can be used to fit the plate inside a partial cylindrical shape as illustrated in FIG. 2. This feature is useful in Computer-to-Plate systems of the internal drum type.

What is claimed is:

1. A method of loading a printing plate onto a cylinder, the method comprising the steps of:

imparting a curvature to said printing plate proximate said cylinder; and loading the printing plate onto said cylinder substantially concurrently with said imparting step, the curvature imparted being such that the printing plate will snugly fit around the cylinder.

2. A method according to claim 1, wherein said cylinder includes a perforated outer surface and subsequent to said loading step securing the plate to said cylinder primarily by partial evacuation of air inside said cylinder.

3. A method according to claim 2, including the steps of:

imaging the printing plate;

unloading the printing plate from the cylinder after said imaging step with an unloading system; and bending out the curvature of the printing plate as it is unloaded so as to restore the printing plate to a flat shape.

4. A method according to claim 2, wherein said imparting step includes the step of:

bending the printing plate with rollers so that the curvature imparted to the printing plate has a radius slightly less than the radius of the cylinder.

5. A method according to claim 2, wherein said cylinder is a printing plate cylinder of a printing press and the method includes the step of:

treating an outside surface of said printing plate cylinder before said imparting step so as to increase friction between the outside surface and said printing plate loaded thereon.

6. A method of loading a printing plate onto an inner surface of a cylinder, the method comprising the steps of:

imparting a curvature to said printing plate by bending said plate beyond the elastic limit, said imparting step performed proximate to said cylinder; and loading the printing plate onto the inner surface of said cylinder substantially concurrently with said imparting step, the curvature once imparted being such that the printing plate fits snugly around the inside of said cylinder.

7. A printing plate loading system, for use with a printing plate and a plate imaging system, the printing plate loading system comprising:

(a) a cylinder;

(b) a cluster of at least three rollers located proximate the cylinder and operative to impart a curvature to the printing plate and to load the printing plate onto the cylinder as the curvature is imparted to the printing plate, the curvature once imparted being such that the printing plate fits snugly around the cylinder, said cluster of at least three rollers comprising:

(i) a pair of pinch rollers having a gap therebetween to snugly receive the printing plate as a flat sheet, wherein at least one of the pinch rollers is motorized so as to feed the printing plate through the gap; and (ii) a bend roller located proximate said pinch rollers and operative to bend the printing plate around said cylinder as it emerges from between said pinch rollers.

8. A printing plate loading system according to claim 7, wherein said pinch rollers and said bend roller extend a length of the cylinder and are oriented parallel to an axis of the cylinder.

9. A printing plate loading system according to claim 7, wherein said cylinder has a perforated outer surface, said cylinder in fluid communication with a vacuum pump operative to evacuate air from within said cylinder and to transmit a vacuum proximate said perforated outer surface so as to substantially secure the printing plate loaded thereon.

10. A printing plate loading system according to claim 9, wherein said cylinder is an imaging drum of a computer-to-plate system.

11. A printing plate loading system according to claim 9, wherein said cylinder is a plate cylinder of a printing press.

12. A printing plate loading system according to claim 9, wherein said cylinder includes an outer cylindrical surface having a frictional layer so as to increase the friction between said cylinder and the printing plate loaded thereon.

13. A printing plate loading system according to claim 9, wherein said cylinder is a plate cylinder of a lithographic, offset, multi-color printing press having on-press imaging capability.

14. A printing plate loading system according to claim 9, including a diverter arranged proximate said cylinder and operative to unload the printing plate after the printing plate has been loaded onto the cylinder.

15. A printing plate loading system according to claim 14, wherein said diverter is pivotally arranged proximate said cylinder and operative to direct the printing plate to said cluster of at least three rollers.

16. A printing plate loading system, for use with a printing plate and a plate imaging system, the printing plate loading system comprising:

(a) a cylinder having a perforated outer surface, said cylinder in fluid communication with a vacuum pump operative to evacuate air from within the cylinder so as to allow a vacuum generated by the vacuum pump to reach said perforated outer surface; and (b) a plurality of rollers located proximate the cylinder and operative to impart a curvature to the printing plate and to load the printing plate onto said cylinder as the curvature is imparted to the printing plate, the curvature once imparted being such that the printing plate fits snugly around said cylinder.

17. A printing plate loading system according to claim 16, wherein said plurality of rollers includes:

(i) a pair of pinch rollers having a gap therebetween to snugly receive the printing plate as a flat sheet and located proximate said cylinder, wherein at least one of the pinch rollers is motorized so as to feed the printing plate through the gap; and (ii) a bend roller located proximate said cylinder and said pair of pinch rollers and operative to bend the printing plate emerging from the said pair of pinch rollers around said cylinder.

18. A printing plate loading system, for use with a printing plate and a plate imaging system, the printing plate loading system comprising:

(a) a cylinder having an outer surface and an inner cylindrical surface, said outer surface having an opening so as to receive the printing plate; and (b) a plurality of rollers located proximate the cylinder and operative to impart a curvature to the printing plate and to load the printing plate through said opening and inside said cylinder onto the inner cylindrical surface as the curvature is imparted to the printing plate, said curvature being such that the printing plate fits snugly within said cylinder.

19. A method of loading a printing plate having a soft metal substrate onto a cylinder, the method comprising the steps of:

feeding said printing plate as a flat sheet between a pair of pinch rollers proximate the cylinder;

bending the printing plate as it emerges from between the pinch rollers with a third roller so as to impart a curvature to the printing plate such that its radius is slightly less than a radius of the cylinder; and automatically loading the printing plate onto said cylinder as the curvature is imparted to said printing plate;

wherein the curvature is such that the printing plate fits snugly around the cylinder.

20. A method according to claim 19, including the steps of:

unloading the printing plate from the cylinder with an unloading system after the printing plate is loaded onto the cylinder; and bending out the curvature of the printing plate as it is unloaded so as to restore the printing plate to a flat shape.

21. A method according to claim 19, wherein said cylinder includes a perforated outer surface and an inner space in fluid communication with a vacuum pump, and subsequent to said automatic loading step securing the plate to said cylinder primarily by partial evacuation of air inside said cylinder using the vacuum pump.

22. A method according to claim 19, wherein said cylinder is a printing plate cylinder of a printing press and before said feeding step, treating an outside surface of said printing plate cylinder so as to increase friction between the outside surface and said printing plate loaded thereon.

* * * * *